US006889488B2

(12) United States Patent
Mäki-Rahkola et al.

(10) Patent No.: US 6,889,488 B2
(45) Date of Patent: May 10, 2005

(54) WRAPPING DEVICE WITH A CIRCULAR TRACK STRUCTURE, AND A FILM FEEDING DEVICE

(75) Inventors: Hannu Mäki-Rahkola, Pantane (FI); Jari Mäki-Rahkola, Kauhajoki (FI); Tapio Tuomiranta, Kurikka (FI)

(73) Assignee: Pesmel Oy, Kauhajoki (FI)

( * ) Notice: Subject to any disclaimer, the term of this patent is extended or adjusted under 35 U.S.C. 154(b) by 0 days.

(21) Appl. No.: 10/425,230

(22) Filed: Apr. 29, 2003

(65) Prior Publication Data

US 2003/0200731 A1 Oct. 30, 2003

(30) Foreign Application Priority Data

Apr. 30, 2002 (FI) ..... 20020815

(51) Int. Cl.[7] ..... B65B 13/10
(52) U.S. Cl. ..... 53/588; 53/389.4; 100/27
(58) Field of Search ..... 53/588, 589, 556, 53/204, 210, 389.4; 100/27, 28

(56) References Cited

U.S. PATENT DOCUMENTS 3,269,085 A * 8/1966 Czajkowski ..... 53/389.4
4,712,354 A * 12/1987 Lancaster et al. ..... 53/588
4,953,336 A * 9/1990 Lancaster et al. ..... 53/588
5,282,347 A 2/1994 Cleine et al.
5,311,725 A * 5/1994 Martin et al. ..... 53/588
5,755,083 A * 5/1998 Cleine ..... 53/588
5,836,140 A * 11/1998 Lancaster, III ..... 53/389.4
6,192,653 B1 2/2001 Maekawa et al.
6,446,418 B1 * 9/2002 Maekawa et al. ..... 53/588
6,520,445 B2 * 2/2003 Araujo ..... 53/588

FOREIGN PATENT DOCUMENTS

EP 0 544 312 B1 6/1993
EP 0 936 141 B1 8/1999
GB 1141832 2/1969

* cited by examiner

*Primary Examiner*—Stephen F. Gerrity
(74) *Attorney, Agent, or Firm*—Darby & Darby

(57) ABSTRACT

A wrapping device having at least a circular track structure which forms a closed track, and a film feeding device which is arranged to circulate along the track and to feed a film around a piece to be wrapped, wherein the film feeding device is provided with a mechanism for fixing a film roll in the film feeding device in a rotating manner, feeding mechanism, through which the film is arranged to be fed at a predetermined film tension, and a drive mechanism which is arranged, if necessary, to rotate the film roll in a direction in which the film is rewound onto the film roll and which is arranged to receive its driving force by mechanical contact between the drive mechanism and the circular track structure. The film feeding device also has a mechanism which is arranged to disconnect and reconnect the contact, wherein the mechanism is controlled either on the basis of the film tension or on the basis of the location of the film feeding device on the track, or on the basis of them both.

24 Claims, 1 Drawing Sheet

WRAPPING DEVICE WITH A CIRCULAR TRACK STRUCTURE, AND A FILM FEEDING DEVICE

FIELD OF THE INVENTION

The invention relates to a wrapping device. The invention also relates to a film feeding device for a wrapping device.

BACKGROUND OF THE INVENTION

For the wrapping of various pieces, for example coils, wrapping devices known as such are used to perform the wrapping by means of a wrapping film, preferably a thin and transparent stretch film made of plastic. The film roll is normally fitted in film feeding means, which are further placed in a carriage which moves along a circular structure and a track formed therein, either around the whole piece or passing via an opening in the central line of the piece.

However, such devices have the problem that the quantity of film to be supplied from the film roll at each moment varies at different locations on the circular tract, because the carriage is not continuously at the same distance from the piece. At some points, the distance is even reduced, having the result that the film between the piece and the carriage does not remain sufficiently stretched all the time, thereby leading to poor wrapping quality, causing tangling of the film or other problems.

One wrapping device is disclosed in EP 0 936 142 A2, or corresponding U.S. Pat. No. 6,192,653. The device comprises a roll device for guiding a film, having a roll placed against the film to maintain the tension of the film but being still allowed to rotate with the film in the feeding direction of the film. The roll is coupled by means of a moment limiter to a motor device which tends to rotate the roll in the opposite direction, but the tension of the film exceeds the set moment and the roll can thus not revolve in the opposite direction. If the film is slackened, the roll can revolve in the opposite direction and the film is re-wound on the film roll, wherein said problem is eliminated. However, problems may be involved in the synchronization of the operation of the guide roll and the film roll, because the film roll may also be provided with a moment limiter.

Another device is presented in EP 0 936 141 B1, in which the tension of the film is continuously monitored with sensor means and in which the film roll can be rotated by means of a motor. If the film is found to become slackened, the film roll is rotated backwards and the loose part is rewound onto the film roll. The device requires an auxiliary motor for the film roll, which is difficult to place in the carriage and which considerably increases the weight of the carriage.

One known device is presented in the publication EP 0 544 312 B1, or corresponding U.S. Pat. No. 5,282,347. The device comprises a roll device placed in a carriage and in which the loose film can be accumulated, if necessary. Some of the rolls are moved by spring force and controlled by changes in the tension of the film. The rolls require a lot of space and increase the weight of the carriage. An increase in the weight will make the moving of the carriage more difficult or will involve an increased power requirement and problems in the placement of the powerful motors.

SUMMARY OF THE INVENTION

It is an aim of the invention to provide a wrapping device as an alternative and an improvement to the disadvantages of prior art. By means of the invention, it is possible to rewind loose film without applying electrical sensors and auxiliary motors and to avoid such structures in the carriage which are coupled to the means for moving the carriage forward, wherein the structure becomes simpler and the design of the different parts can be kept separate.

By means of the invention, it is easier to design the carriage and to use alternative or even totally new types of structures, because the structures taking care of the loose film do not necessarily need to cooperate, for example, with the motor for moving the carriage or with the transmission mechanisms. Replaceability is increased and the maintenance and the replacement of parts become easier.

BRIEF DESCRIPTION OF THE DRAWINGS

In the following description, the invention will be described in more detail by using, as an example, an advantageous embodiment of the invention with reference to the appended drawings, in which.

DETAILED DESCRIPTION OF THE INVENTION

Figure 1:
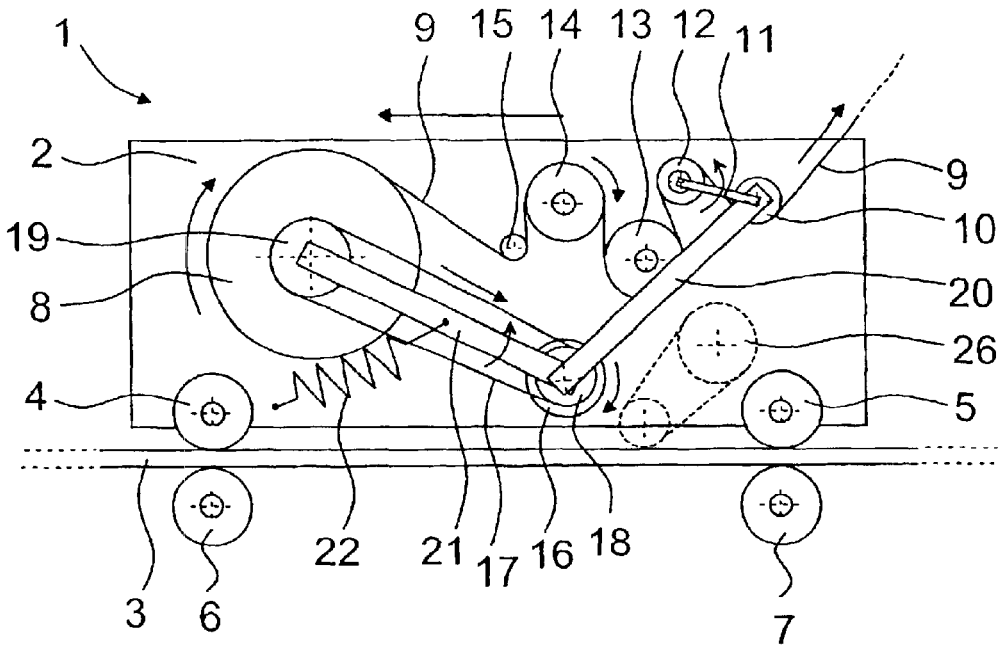
FIG. 1 shows a film feeding device seen from the side and coupled to the track structure of the wrapping device, as well as the operation of the device when the tension of the film is simultaneously predetermined or higher than that, FIG. 2 shows the film feeding device seen from the side and coupled to the track structure of the wrapping device, as well as the operation of the device when the tension of the film is simultaneously lower than the predetermined value.
Figure 2:
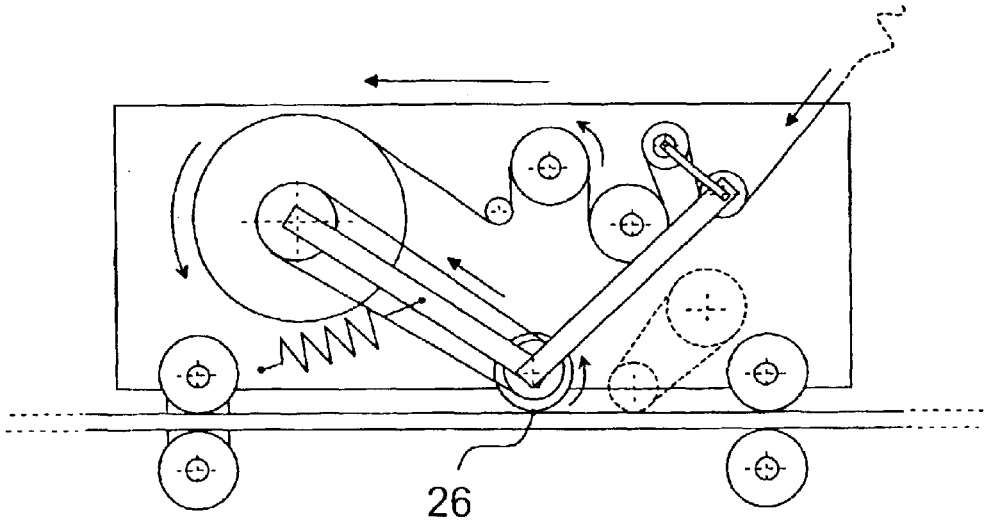

FIGS. 1 and 2 show the principle of operation of the film feeding device 1, and in this description, the device 1 will also be called a carriage and the feeding means 10, 12, 13, 14, 15 will also be called guide rolls. The carriage 1 and the guide rolls are shown in a reduced schematic view to illustrate the operation. FIG. 1 shows a situation, in which the film 9 to be fed is suitably tensioned, wherein the tension of the film is predetermined or higher than that, and it is fed from a film roll 8 forward and further around a piece to be wrapped. The end of the film 9 is attached to the piece, wherein when the carriage 1 moves, the film 9 is simultaneously tightened by the effect of the guide rolls and is unwound from the film roll 8. FIG. 2 shows a situation in which the film 9 has been slackened and it is rewound around the film roll 8.

The carriage 1 comprises a frame structure 2 in which the functional parts are coupled. The presented carriage 1 is shown without a motor or means by whose force effect the carriage 1 is moved along the track structure 3 and following a desired path. The motors, or the means 26 moving the carriage forward, can be implemented by means known as such, wherein the frame 2 is provided, for example, with an electrical motor to rotate, for example, a cogged wheel which is placed against a cogging on the track 3. By means of the cogged wheel, the carriage 1 is driven forward, and simultaneously the necessary electrification is provided by means of sliding connections, wherein the carriage 1 is provided with contacts and the track 3 is provided with an electrified conductor track, along which the contacts of the carriage slide. The track 3 is a circular track forming an endless path along which the carriage 1 travels. The track 3 has, for example, such a shape that it comprises two horizontal track parts which are on top of each other and which are connected by means of vertical arch-like track parts, wherein during a cycle, the carriage 1 rotates around a direction which is horizontal and transverse to the plane in which the carriage 1 moves. The carriage 1 is supported to the track 3 by means of upper wheels 4 and 5 and lower wheels 6 and 7, carrying the carriage 1 in its different positions. The wheels are placed on opposite sides of the track structure 3. The track 3 is, for example, a flat plate structure supported or connected to the frame.

The carriage 1 is provided with a film roll 8 from which the film 9 is fed and guided by guiding rolls off the carriage 1 and further around the piece to be wrapped, which is placed inside the circular track or through which the carriage 1 and the track 3 are placed to pass. In this case, particularly coils made of a metal band, having a large inner opening, are feasible. If necessary, the track is provided with a port which can be opened or a movable part to insert the track 3 in the piece and to form a continuous track for the carriage 1. Furthermore, a rotating device is placed under the track structure 3 to rotate the coils during the wrapping, wherein each part of the coil can be wrapped. The rotating axis of the coil is its longitudinal axis which is placed in parallel with the track.

The guide rolls are used to keep the film 9 suitably tensioned by braking and to take care of the pre-tensioning and guiding of the film. In the shown embodiment, the guide rolls also comprise a cam roll 10 whose position depends on the tension of the film 9. Thus, the cam roll 10 is a means which detects the tension of the film and whose position is dependent on the tension. The cam roll 10 is coupled to a rotatable lever 11 whose other end is connected to the rotation axis of the roll 12 or in another fixed position. The roll 12 is freely rotatable. The guide rolls also comprise a free roll 15 which guides the film 9 unwound from the film roll 8. Rolls 13 and 14 are provided between the rolls 12 and 15. The roll 13 cooperates with the braking roll 14, because they are coupled to each other by a transmission, wherein they rotate in synchronization with each other. The transmission is preferably implemented by means of cogged wheels placed at the ends of the rolls, around the shaft. The locations of the rolls 12, 13, 14 and 15, as well as of the film roll are fixed in relation to each other.

The carriage 1 also comprises a drive roll 16 which is not in contact with the track 3 when the film 9 is tensioned. The drive roll 16 and the film roll 8 are coupled to each other by means of a fixed transmission 17, 18, 19, wherein they rotate in synchronization and in the same direction. The gearing of the transmission is preferably implemented by means of a cogged belt 17 and cogged belt pulleys 18 and 19. In this case, the transmission is fixed, wherein the drive mechanism is also arranged to rotate with the film roll 8 in the direction in which the film is fed from the film roll 8 when the tension of the film is predetermined or higher than that. In the situation of FIG. 1, the force effect rotating the roll 16 is obtained from the film roll 8 which, in turn, is rotated by the tensioned film 9 being unwound. The tensioned film 9 keeps, by means of its force effect, the drive roll 16 off the track 3, which is implemented by means of a lever 20 in such a way that also the drive roll 16 is coupled to the lever 20. The lever 20, in turn, is coupled to the lever 11 or the cam roll 10 in such a way that a movement of the the cam roll 10 will also affect the position of the lever 20. The drive roll 16 is coupled to the film roll 8 in such a way that the drive roll 16 can be turned in relation to the film roll 8 and away from the track 3 when the lever 20 tends to move the drive roll 16. The rotation is made possible by means of a lever 21 which is coupled between the shafts of the drive roll 16 and the film roll 8. The cam roll 10 and the levers 11 and 20 constitute a mechanism which controls the drive roll 16 and thereby the connection and disconnection of the drive mechanism to the source of the driving force.

The drive roll 16, the spring 22, and the parts 17, 18 and 19 of the gearing constitute the drive mechanism which rotates the film roll 8 and receives its driving force via a mechanical contact 26. In this case, the contact is the contact of the rolling driving roll 16 along the stationary track 3, wherein frictional forces rotate the drive roll 16 which is pushed by the spring 22 against the surface of the track 3. If the force effect of the tension of the film is greater, it will overcome the effect of the spring 22, and the drive roll is pulled off the track, wherein the contact is disengaged. In this case, it should be noted that the driving force is only generated when the carriage 1 is in motion, wherein the source of the driving force is the movement between the carriage 1 and the circular track structure 3. Alternatively, the mechanical contact 26 can also be formed by a circular crawler track placed against the track 3. Furthermore, the track 3 may be provided with pins or other protrusions placed at regular intervals, which hit corresponding means in the drive mechanism of the carriage 1 and thereby move or rotate the drive mechanism and the film roll backwards, for example stepwise. The tensioned film 9 moves the drive mechanism in such a way that it will no longer hit the protrusions but the slack film 9 will allow the contact. In FIG. 2, the contact is continuous, but it may also be sectional or periodical, as presented above in connection with the protrusions. The aim is to rotate the film roll 8 backwards.

The force effect of the slack film 9 is not sufficient to resist the force effect of the spring 22, wherein the spring 22 presses the drive roll 16 against the track 3, as shown in FIG. 2. Instead of the spring 22, it is also possible to apply gas springs or other means which provide a suitable counter-force and which are preferably adjustable. Furthermore, the slack film 9 must be rewound onto the film roll 8, which is implemented by providing the force effect to rotate the film roll 8 from the drive roll 16, which is now pressed against the track 3 and tends to roll along it. The carriage 1 is driven along the track 3, which also causes the rotation of the roll 16. In comparison with the situation of FIG. 1, the rotating direction of the drive roll 16 is reversed, wherein the rotating direction of the film roll 8 is simultaneously reversed and the loose film 9 is now rewound onto the film roll 8.

The surface of the drive roll 16 or the track 3 or them both can be roughened or provided with a suitable embossing to prevent the sliding or slipping of the drive roll 16. Thus, the track 3 can also be equipped with a cogging, against which the corresponding cogging of the drive roll 16 is placed. The track 3 or the drive roll 16 may also be coated with a suitable material, such as rubber, to achieve higher friction in the contact 26.

The film roll 8 is mounted on its rotation axis preferably in such a way that the film roll which has become empty can be easily replaced with a new, full film roll. The distance between the rolls 13 and 14 can be preferably set to enable controllability. The spring 22 or the corresponding gas spring can also be installed in such a way that they tend to push the lever 21 or the drive roll 16 towards the track 3. In FIG. 1, the spring 22 is coupled in such a way that it tends to pull the lever 21 and the drive roll 16 towards the track 3. In one embodiment, the frame 2 comprises two parallel plates between which the guide rolls 12, 13, 14 and 15 are mounted on bearings at each end. Between the plates, there may be connecting structures to support and reinforce the structure. Thus, when looking at FIG. 1, the front plate is removed and only the back plate is exposed. The lever 20 is preferably placed outside the front plate, and the front plate is provided with a groove in which the shaft of the roll 16 can move. The shaft supporting the film roll 8 is, in turn, mounted on bearings in only one of the plates, wherein the opposite plate is provided with an opening, through which the film roll 8 can be replaced. Consequently, the carriage 1 is provided with means which enable the fixing of the film roll 8 in the carriage in a replaceable and rotatable manner. The length of the rolls 10, 12, 13, 14, and 15 corresponds to the width of the film 9 or is greater than that. The drive roll 16 is narrow, and only one end of its shaft journal 25, shown in FIG. 3, is mounted on bearings in the lever 21.

In one embodiment, the number of upper and lower wheels totals eight, wherein they are placed close to each edge of the track 3 and on opposite sides of the track 3. In the presented embodiment, the width of the track 3 corresponds substantially to the width of the carriage 1. Each plate is provided with four wheels, and the lower wheels are connected to the frame 2 by means of such structures which extend around the edges of the track 3. The mounting of the rolls and wheels on bearings and their installation are implemented by utilizing mechanical components which are known as such and whose application in the principle of the carriage 1 of FIGS. 1, 2 and 3 will be obvious on the basis of this description for a person skilled in the art. The adjustment of the force effect of the spring 22 and the other functions can be easily implemented and may also be based on pure experimentation and the selection of a suitable component.

Figure 3:
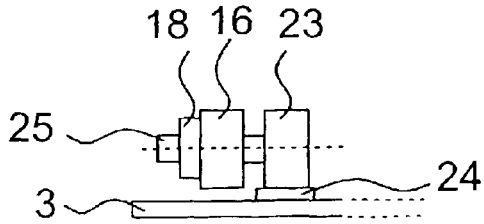
FIG. 3 shows guide wheels of the mechanism seen in the direction of the track structure.

FIG. 3 shows, in a detail, the drive roll 16 and the guide roll 23 alone when they are pushed towards the track 3 in a location where the track 3 is also provided with an elevation 24. In this case, the elevation 3 forms a guide profile along which the guide roll 23 rolls and forces the drive roll 16 off the track 3. In this way, the guide roll 23 disconnects the contact 26 shown in FIG. 2 and forces the drive roll 16 to move. In the figure, the rolls 16 and 23 are seen from the direction of the track 3 and the movement of the carriage 1, in other words seen from the right when compared with FIG. 1 or 2.

The drive roll 16 can now be forced off the track 3, which makes it possible to guide and time the rewinding in a more precise manner. For this purpose, a freely rotating roll 23 is placed on the same shaft as the drive roll 16, wherein if its diameter corresponds to that of the drive roll 16, it will also roll along the track 3, or is smaller, wherein it will not be placed against the flat track 3. The drive mechanism does not receive its driving force via the guide roll 23. Now, the track 3 can be provided, at a desired location, with a guide profile 24 by the guide roll 23, wherein the guide roll 23 can be used to force the drive roll 16 off the track by raising it, wherein the film roll 8 is not rotated backwards. This situation corresponds to the situation of FIG. 1, but it can now be provided by active measures, with the help of the elevation 24, by using forced control. The guide roll 23 connected to the shaft 25 constitutes a mechanism which guides the drive roll 16 and thereby the connection and disconnection of the drive mechanism to the source of the driving force. The guide roll 23 may also be coupled to the lever 21, wherein the lever 21, in turn, moves the drive roll 16. If the geometry and the force effect of the guide roll 23 are directed in a suitable way, the guide roll 23 may also be coupled to the lever 20 which lifts the drive roll 16 off the track 3. The drive roll 16 can also be placed underneath the track 3, wherein the directions of motion of the levers must be arranged to correspond to this situation. Similarly, the guide roll 23 can be on opposite side of the track 3, wherein the guide roll 23 must be arranged to move the drive roll 16 in a corresponding manner. The elevation 24 can also be constructed as a separate track structure which is parallel to the track 3 and which is followed by the guide roll 23. Said track may be continuous or may be placed only in a section of the track 3, which is also typical with the elevation, because forced guidance is only needed at desired points. Preferably, the location of the guide profile 24 is adjustable or its length can be changed by means of, for example, extension pieces.

If the behaviour of the film 9 is well known in advance, or if pieces of very constant shapes are wrapped, the slackening of the film can be estimated already beforehand and thereby those points of the track in which rewinding will be needed are known in advance. In a simple embodiment of the invention, the drive mechanism receives its control from the guide profile 24 alone, wherein the movement of the cam roll 10 or the lever 20 are unnecessary. In the embodiment shown in FIGS. 1, 2 and 3, both the guide profile 24 and the moving cam roll 10 are used. The guide profile 24 will not be compulsory, if forced guidance is not necessary or if the operation of the cam roll 10 is sufficiently accurate.

The position of the drive roll 16 can also be set by means of a mechanism formed by electrical actuators, wherein the actuators, controlled by the movement of the cam roll 10, pull the drive roll 16 off the track 3, if necessary. The position of the cam roll 10 is used as a tension indicator and couples the actuator to operation in a rotating or linear movement. For this purpose, the frame 2 must be equipped with actuators and it must be provided with electrification for sensors and/or actuators. In this case, sliding contacts, known as such, are applied, which slide along a guide mounted on the track 3. The tension indicator may also be the guide profile 24 alone, which guides the actuator by means of the guide roll 23 and the sensor. In these embodiments, the carriage 1 must be equipped with electrification, wherein all the advantages of a simple, purely mechanical system will not be achieved. A more complex system is also represented by an embodiment of the invention, in which sensors are used in the carriage 1 to find out its location on the track 3, and the position of the drive roll 16 is controlled according to the location. For example, the sensor detects mechanically, optically or electrically marks which are fixed on the track 3 and are preferably movable to cause the release or return of the drive roll 16 in an alternating manner.

The invention is not limited solely to the advantageous embodiment presented above, but it may vary within the scope of the appended claims. For example, the upper and lower wheels are connected, for example, to a separate frame structure, in which the frame 2 is arranged to be connected for maintenance and quick replacement of broken parts. The separate frame is provided, for example, with a different set of wheels or a different motor, wherein the selection of the motor alternative for a different track is easy and quick and wherein it is possible to form various replaceable module structures.

What is claimed is:

1. A wrapping device comprising at least a circular track structure which forms a closed track, and a film feeding device which is arranged to circulate along said track and to feed a film around a piece to be wrapped, wherein the film feeding device is provided with at least:

means for fixing a film roll in the film feeding device in a rotating manner, feeding means, through which the film is arranged to be fed at a predetermined film tension, and a drive mechanism which is arranged to rotate the film roll in a direction, in which the film is rewound on the film roll and which is arranged to receive its driving force by means of a mechanical contact between the drive mechanism and the circular track structure, a control mechanism which is arranged to disconnect and reconnect said contact, wherein said control mechanism is controlled either on the basis of the film tension or on the basis of the location of the film feeding device on said track, or on the basis of them both.

2. The wrapping device according to claim 1, wherein said control mechanism is arranged to disconnect said contact when the film tension reaches or exceeds the predetermined value, and to reconnect said contact when the film tension is lower than the predetermined value.

3. The wrapping device according to claim 2, wherein said control mechanism is arranged to receive its control from a guide profile which is in the circular track structure and placed on at least a section of said track.

4. The wrapping device according to claim 2, wherein said drive mechanism comprises at least one wheel rolling along the circular track structure, which can be moved off the circular track structure and back, by means of said control mechanism.

5. The wrapping device according to claim 2, wherein said drive mechanism is arranged to allow the rotation of the film roll in a direction in which the film is fed around the piece to be wrapped, when the tension reaches or exceeds the predetermined value.

6. The wrapping device according to claim 1, wherein said control mechanism is arranged to receive its control from a guide profile which is in the circular track structure and placed on at least a section of said track.

7. The wrapping device according to claim 1, wherein said control mechanism is provided with at least one wheel rolling along the circular track structure, on the basis of whose position said control mechanism is controlled.

8. The wrapping device according to claim 1, wherein said drive mechanism comprises at least one wheel rolling along the circular track structure, which can be moved off the circular track structure and back, by means of said control mechanism.

9. The wrapping device according to claim 1, wherein said drive mechanism is arranged to allow the rotation of the film roll in a direction in which the film is fed around the piece to be wrapped, when the tension reaches or exceeds the predetermined value.

10. The wrapping device according to claim 1, wherein said drive mechanism is separate in relation to a drive mechanism which, in turn, is arranged to drive the film feeding device along said track.

11. The wrapping device according to claim 1, wherein the source of driving force for said drive mechanism is the mutual movement between the film feeding device and the circular track structure, which, via said contact, is simultaneously arranged to maintain the operation of the drive mechanism.

12. The wrapping device according to claim 1, wherein said control mechanism comprises a set of levers, to which the drive mechanism is coupled and whose position is arranged to be controlled by the force effect which is dependent on the tension of the film.

13. The wrapping device according to claim 1, wherein said control mechanism comprises means for detecting the tension of the film.

14. The wrapping device according to claim 13, wherein the means for detecting the tension of the film comprise a cam roll which is placed against the film and whose position is dependent on the force effect of the film tension.

15. A film feeding device for a wrapping device, wherein the film feeding device comprises at least:

means for fixing a film roll in the film feeding device in a rotating manner, feeding means, through which the film is arranged to be fed at a predetermined film tension around a piece to wrapped, and a drive mechanism which is arranged to rotate the film roll in a direction, in which the film is rewound on the film roll and which is arranged to receive its driving force by means of a mechanical contact which is between the drive mechanism and a circular track structure of the wrapping device, wherein the film feeding device is arranged to move along a track arranged in the wrapping device, a control mechanism which is arranged to disconnect and reconnect said contact, wherein said control mechanism is controlled either on the basis of the film tension or on the basis of the location of the film feeding device on said track, or on the basis of them both.

16. The film feeding device according to claim 15, wherein said control mechanism comprises means for detecting the tension of the film.

17. The film feeding device according to claim 15, wherein said control mechanism is arranged to receive its control from the circular track structure.

18. The film feeding device according to claim 16, wherein said control mechanism is arranged to receive its control from the circular track structure.

19. A wrapping device comprising at least a circular track structure which forms a closed track, and a film feeding device which is arranged to circulate along said track and to feed a film around a piece to be wrapped, wherein the film feeding device is provided with at least:

means for fixing a film roll in the film feeding device in a rotating manner, feeding means, through which the film is arranged to be fed at a predetermined film tension, and a drive mechanism which is arranged to rotate the film roll in a direction, in which the film is rewound on the film roll when the film tension is lower than the predetermined tension and which is arranged to receive its driving force by means of a mechanical contact between the drive mechanism and the circular track structure, a control mechanism which is arranged to disconnect and reconnect said contact, wherein said control mechanism is controlled on the basis of the film tension.

20. The wrapping device according to claim 19, wherein said control mechanism is arranged to disconnect said contact when the film tension reaches or exceeds the predetermined value, and to reconnect said contact when the film tension is lower than the predetermined value.

21. The wrapping device according to claim 20, wherein said drive mechanism comprises at least one wheel rolling along the circular track structure, which can be moved off the circular track structure and back, by means of said control mechanism.

22. The wrapping device according to claim 20, wherein said drive mechanism is arranged to allow the rotation of the film roll in a direction in which the film is fed around the piece to be wrapped, when the tension reaches or exceeds the predetermined value.

23. The wrapping device according to claim 19, wherein said drive mechanism comprises at least one wheel rolling along the circular track structure, which can be moved off the circular track structure and back, by means of said control mechanism.

24. The wrapping device according to claim 19, wherein said control mechanism comprises a set of levers, to which the drive mechanism is coupled and whose position is arranged to be controlled by the force effect which is dependent on the tension of the film.

* * * * *